United States Patent [19]

Klundt

[11] 4,079,685

[45] Mar. 21, 1978

[54] LUBRICATING OIL SEAL ON SEWING MACHINES

[75] Inventor: Kurt Klundt, Hirschhorn, Germany

[73] Assignee: Pfaff Industriemaschinen GmbH, Germany

[21] Appl. No.: 809,779

[22] Filed: Jun. 24, 1977

[30] Foreign Application Priority Data

Jul. 23, 1976 Germany ..... 7623248

[51] Int. Cl.[2] ..... D05B 71/00

[52] U.S. Cl. ..... 112/256

[58] Field of Search ..... 112/256, 259; 184/6.15

[56] References Cited

U.S. PATENT DOCUMENTS

| | | | |
|---|---|---|---|
| 2,047,730 | 7/1936 | Fleckenstein | 112/256 |
| 2,742,010 | 4/1956 | Rabezzana | 112/256 |
| 3,296,989 | 1/1967 | Orth et al. | 112/256 |

*Primary Examiner*—George H. Krizmanich

*Attorney, Agent, or Firm*—McGlew and Tuttle

[57] ABSTRACT

A sewing machine, comprises a sewing machine head with a needle bar bushing supported in the head and a needle bar engaged in the bushing for upward and downward axial movement. The sewing machine includes an oil pan below the head and a scraping wick is engaged around the bar in the bushing and bears against a reabsorbing wick which extends from the scraping wick to the oil pan. The head is advantageously provided with a head cover which covers a recess having a pad which engages against the reabsorbing wick and biases it into contact with the scraping wick. In addition, the construction includes an additional wick which extends in an axial direction from a location above the scraping wick to a location at the lowermost end of the bushing and it is located between separated ends of the scraping wick and provides an oil-conducting connection with the scraping wick.

3 Claims, 2 Drawing Figures

LUBRICATING OIL SEAL ON SEWING MACHINES

FIELD AND BACKGROUND OF THE INVENTION

This invention relates in general to sewing machines and, in particular, to a new and useful lubricating oil seal on a sewing machine having a needle bar bushing arranged in the housing head and a needle bar mounted in the housing head for upward and downward movement.

DESCRIPTION OF THE PRIOR ART

Fast-running sewing machines, particularly those with sliding bearings, in which the drive parts execute a swinging or reciprocating motion, require effective lubrication. Intensive lubrication, however, causes lubricating oil to issue at the ends of the bearing bushings. With a needle bar bushing located at the underside of the housing head, however, the issuance of even the smallest amount of oil is undesirable, as, in this case, there is danger that the issuing oil will not only dirty the machine, but the work as well.

In a known sewing machine construction (German Pat. No. 2,229,005), the lower end of the guide bore of the needle bar bushing is enlarged conically, whereby, lubricating oil scraped off by the needle bar runs down along the cone surface. The scraped-off oil then drips into an annular catch container which is open at the top and which is applied to the lower end of the needle bar bushing and is connected with a pump through several bores in the needle bar bushing and housing head, and by means of a suction tube. This lubricating oil seal device is effective without restriction only if the inner, upwardly bent limiting wall of the catch container has sufficient spacing from both the needle bar and from the cone surface, so that oil cannot be transferred to the limiting wall or be scraped off on it. However, in the high-speed operation of sewing machines, depending on the type of work, much sewing dust is generated and whirled up, so that there is a danger that, after a relatively short time, the spaces between the inner limiting wall of the catch container and the cone surface and the needle bar are filled up with sewing dust. Thus, with the known lubricating oil seal device, it becomes partially or even completely ineffective after a relatively short time and must be cleaned.

SUMMARY OF THE INVENTION

To overcome this disadvantage, the invention provides a lubricating oil seal device for the needle bar bushing on a sewing machine wherein the oil retention or oil return means are shielded from sewing dust. The solution of this problem is characterized in that a reabsorbing wick known per se, extending from the interior of the housing head to the oil pan, is in contact with a scraping wich which embraces the needle bar inside of the needle bar bushing.

In the lubricating oil seal device, according to the invention, the excess oil present on the needle bar is scraped-off or absorbed by the scraping wick, which is preferably disposed in the lower region of the needle bar bushing, thus preventing the excess oil from issuing at the lower end of the needle bar bushing. The oil taken up by the scraping wick is then absorbed by the reabsorbing wick and is conveyed back into the oil pan which is situated lower than the housing head and the oil flow in the reabsorbing wick is brought back by the action of gravity and by capillary action. As the reabsorbing wick and the scraping wick lie inside the housing, or respectively, inside the needle bar bushing, they are shielded from sewing dust and, therefore, cannot foul. In this way, a permanently constant sealing is achieved without the necessity of cleaning the sealing device in between.

According to another proposal of the inventive device, an oil-absorbing pad, arranged in a recess of the housing head, serves to maintain the upper end of the reabsorbing wick in oil-conducting connection with the scraping wick. The compressed pad presses the reabsorbing wick tightly against the scraping wick and thereby ensures a safe and durable oil-conducting connection between the two wicks. Since the pad is made of an oil-absorbing material and, therefore, becomes filled with oil, it forms an oil reservoir which releases oil to the needle bar through the two wicks in the event the normal lubricating oil supply to the needle bar is interrupted.

According to the invention, only the excess lubricating oil is removed from the needle bar by means of the scraping wick. To ensure sufficient lubrication below the scraping wick, a thin film of oil must be maintained on the needle bar emerging from the needle bar bushing. It may then occur that the lower entering edge of the needle bar bushing scrapes minute quantities of this oil film from the needle bar, whereupon, the scraped-off oil gradually migrates to the lowest point of the needle bar bushing. In order that even these almost negligibly small amounts of oil, which collect after a prolonged time at the lower end of the needle bar bushing will be returned to the oil pan, another proposal of the invention proposes to arrange in a substantially axial bore of the needle bar bushing, a wick whose upper end is in contact with the scraping wick, while its lower end is in contact with the lowest edge of the needle bar bushing.

Accordingly, it is an object of the invention to provide a sewing machine which includes a needle bar which is reciprocated within a bushing in contact with a scraping wick and which further includes a reabsorbing wick which is in contact with the scraping wick and extends downwardly to an oil pan for returning oil therefrom.

A further object of the invention is to provide a lubricating device for sewing machines which guards against the appearance of oil in the sewing parts and nevertheless provides adequate lubrication for the reciprocation of the needle bar.

Another object of the invention is to provide a lubricating oil seal on sewing machines which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawings and descriptive matter in which there is illustrated a preferred embodiment of the invention.

DESCRIPTION OF THE PREFERRED EMBODIMENT

Figure 1:
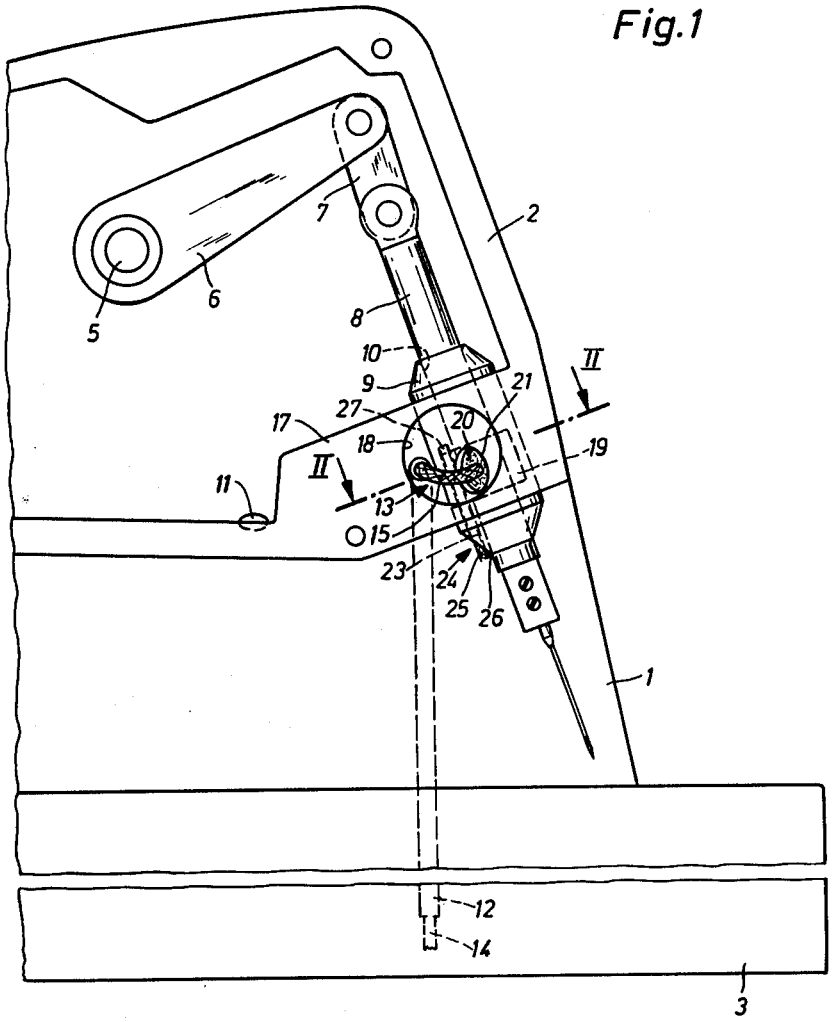
FIG. 1 is a partial side elevational view of a sewing machine with the sealed needle bar bushing thereon, constructed in accordance with the invention.
Figure 2:
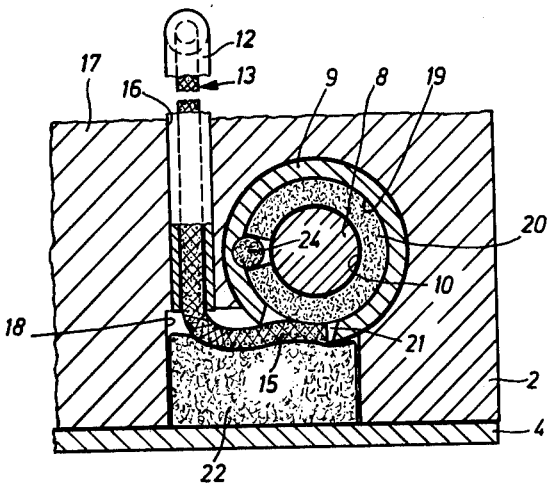
FIG. 2 is an enlarged sectional view, taken along the line II—II of FIG. 1.

Referring to the drawing in particular, the invention embodied therein, comprises a sewing machine which has a reciprocating needle bar 8 which rides in a bushing 9 and which, in accordance with the invention, has means for adequately lubricating the bushing and for ensuring that no lubricating oil appears in the sewing spaces.

As shown in FIG. 1, the overcase sewing machine comprises a housing 1 with a head 2 and an oil pan 3 in the lower region of the housing 1. A head cover 4 closes housing head 2, which is shown in an open position in FIG. 1. A crank 6 is fastened on a drive shaft 5 in the housing head 2. Though a link 7, the crank 6 drives a needle bar 8, which is received in a needle bar bushing 9.

Lubrication of the needle bar 8 in needle bar bushing 9 is effected by supplying lubricating oil drop-by-drop to the upper part of the needle bar 8 in a manner which has not been shown. This oil flows down along the needle bar 8 and is drawn by the needle bar 8 in the end into the bearing gap between it and the bushing 9. The penetration of the lubricating oil into the needle bar bushing 9 can be facilitated by a funnel-shape enlargement of the upper end of bore 10 of bushing 9. Oil dripping or flowing from the needle bar 8 and bushing 9, inside housing head 2, is returned to the oil pan 3 by means of a bore provided in housing 1, of which only the inlet opening 11 is shown in FIG. 1.

A reabsorbing wick 13 surrounded by a flexible tube 12 is arranged in housing 1, whose lower end 14 is immersed in the oil in the oil pan 3, while its upper end 15 passes through a bore 16 in the wall 17 of housing head 2 and extends into a recess 18 in wall 17. Recess 18 extends from the flat side of housing head 2, which is covered by the head cover 4, to needle bar bushing 9.

Needle bar bushing 9 has an internal annular groove 19 in its lower half, in which a scraping wick 20 having a rectangular cross-section contiguous to the needle bar 8 is arranged. There is further provided in the needle bar bushing 9, a recess 21, through which recess 18 is connected with annular groove 19. A pad 22, of oil-absorbing material, which is arranged in the recess 18 is compressed by applying the head cover 4 and presses against the upper end 15 of the reabsorbing wick 13 through the recess 21 and against the scraping wick 20. In this manner, an effective and durable oil-conducting connection is obtained between the reabsorbing wick 13 and the scraping wick 20.

In the needle bar bushing 9, spaced from the bore 10 receiving the needle bar 8, is a bore 23, which extends from the lower end of the needle bar bushing 9 to the annular groove 19. A wick 24 whose lower end 25 applies against the lowerst edge 26 of needle bar bushing 9 is arranged in bore 23, while its upper end 27, within the annular groove 19, fits between the two ends of the scraping wick 20 and is thus in oil-conducting connection with scraping wick 20.

Sufficient lubricating oil is scraped off the needle bar 8 by the scraping wick 20, or is absorbed out of the bearing gap between needle bar 8 and bushing 9 that, on the portion of the needle bar 8 present below the scraping wick 20, only a thin oil film remains, which is just enough to lubricate the lower portion of bushing 9. The scraped-off absorbed excess lubricating oil then penetrates into the upper end 15 of the reabsorbing wick 13 and, finally, flows back through the reabsorbing wick 13 into the oil pan 3. The oil flow inside the reabsorbing wick 13 results from the fact that there is a level difference between the upper end 15 and the lower end 14 and, consequently, the oil present in the reabsorbing wick 13 is drawn down by gravity as well as by capillary action.

In the event small amounts of oil should be scraped off on the inflow edge of the needle bar bushing 9 by the portion of the needle bar 8 which is wet with only a thin oil film below the scraping wick 20, during the upward movements, this oil migrating to the lowest edge 26 of the needle bar bushing 9 is then also prevented from dripping onto the work. These very small amounts of oil are absorbed by wick 24 and returned into the oil pan through the scraping wick 20 and reabsorbing wick 13.

The reabsorbing wick 13 is designed so that its transport capacity is greater than the quantity of oil supplied through the bearing gap between the needle bar 8 and its bushing 9.

The reabsorbing wick 13 and scraping wick 20 are completely shielded from sewing dust. Therefore, they cannot become fouled and, hence, cannot decrease in their absorption capacity. Sewing dust can only deposit at the lower end 25 of wick 24. Such an accumulation of dust does not impair the absorption capacity of wich 24, or only insubstantially so, as the dust consisting of textile fiber particles is itself able to absorb oil and therefore does not clog the wick 24.

While a specific embodiment of the invention has been shown and described in detail to illustrate the application of the principles of the invention, it will be understood that the invention may be embodied otherwise without departing from such principles.

What is claimed is:

1. A sewing machine, comprising a sewing machine head, a needle bar bushing supported in said head, a needle bar engaged in said bushing for axial movement during the sewing operation, means defining an oil pan below said bushing, a scraping wick in said bushing in surrounding engagement with said needle bar, and a reabsorbing wick extending from said bushing in contact with said scraping wick to said oil pan.

2. A sewing machine, according to claim 1, wherein said housing head has a recess therein, and an absorbing pad in said recess bearing against said reabsorbing wick to hold it in oil-conducting connection with said scraping wick.

3. A sewing machine, according to claim 1, including an axially extending recess in said bushing, a bushing wick disposed in said recess having an upper portion in contact with said scraping wick and having a lower end adjacent the lower end of said needle bar bushing.

* * * * *